US007705818B2

(12) United States Patent
Aoki et al.

(10) Patent No.: US 7,705,818 B2
(45) Date of Patent: Apr. 27, 2010

(54) ELECTRO-OPTICAL DEVICE, SIGNAL PROCESSING CIRCUIT THEREOF, SIGNAL PROCESSING METHOD THEREOF AND ELECTRONIC APPARATUS

(75) Inventors: Toru Aoki, Shiojiri (JP); Sadasumi Uchiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 956 days.

(21) Appl. No.: 11/159,110

(22) Filed: Jun. 23, 2005

(65) Prior Publication Data

US 2006/0007723 A1 Jan. 12, 2006

(30) Foreign Application Priority Data

Jul. 9, 2004 (JP) ..... 2004-203615
Mar. 28, 2005 (JP) ..... 2005-090774

(51) Int. Cl.
*G09G 3/34* (2006.01)

(52) U.S. Cl. ..... 345/98; 349/75

(58) Field of Classification Search ..... 345/50, 345/55, 84–92, 98–101, 211–213
See application file for complete search history.

(56) References Cited

U.S. PATENT DOCUMENTS 5,831,605 A * 11/1998 Yasui et al. ..... 345/211
6,018,329 A * 1/2000 Kida et al. ..... 345/60
6,069,609 A * 5/2000 Ishida et al. ..... 345/596
6,531,996 B1 * 3/2003 Murade ..... 345/98
6,563,478 B2 5/2003 Aoki
6,778,157 B2 * 8/2004 Aoki ..... 345/87
2001/0015711 A1 * 8/2001 Aoki ..... 345/92
2002/0044126 A1 * 4/2002 Aoki ..... 345/96
2002/0067326 A1 * 6/2002 Aoki ..... 345/89

FOREIGN PATENT DOCUMENTS

CN 1300047 A 6/2001
JP 2000-112437 A 4/2000
JP 2001-166276 A 6/2001
JP 2001-201732 A 7/2001
JP 2001201732 A * 7/2001
JP A-2002-182622 6/2002
JP 2002-229529 A 8/2002

* cited by examiner

*Primary Examiner*—Amare Mengistu
*Assistant Examiner*—Vinh T Lam
(74) *Attorney, Agent, or Firm*—Oliff & Berridge, PLC

(57) ABSTRACT

An electro-optical device includes a plurality of scanning lines that extends in a row direction, a plurality of data lines that extends in a column direction, a plurality of pixels which are provided at intersections of the scanning lines and the data lines and whose gray-scale levels are designated by data signals supplied through the data lines, a common electrode that is provided so as to be opposite to pixel electrodes, a shift register that outputs sampling signals to sequentially select a plurality of blocks each composed of a plurality of the data lines, in a period where the scanning lines are selected, a sampling circuit that samples the data signals to the plurality of data lines belonging to the block selected by the sampling signal, respectively, a data signal supply circuit that changes the potential of the data signal into a higher level and a lower level than a predetermined potential in every predetermined period and then alternately outputs the potentials, and a correction circuit that superimposes, on the data signals, correction signals for correcting potential errors that are generated in the data lines belonging to each of the blocks, corresponding to the potentials of the data lines.

6 Claims, 9 Drawing Sheets

ELECTRO-OPTICAL DEVICE, SIGNAL PROCESSING CIRCUIT THEREOF, SIGNAL PROCESSING METHOD THEREOF AND ELECTRONIC APPARATUS

BACKGROUND OF THE INVENTION

1. Technical Field

The present invention relates to a technique for preventing the deterioration of display quality appearing in a column direction.

2. Related Art

In recent years, projectors in which, first, a small image is formed by an electro-optical panel using, for example, liquid crystal and then the small image is enlarged by an optical system to be projected onto a screen have come into widespread use. The projector does not have a function of forming an image, but is supplied with image data (or image signals) from a host device, such as a personal computer or television tuner. The image data designates the gray-scale levels (brightness) of pixels, and is supplied by vertically and horizontally scanning the pixels arranged in a matrix. Therefore, it is preferable to drive the electro-optical panel used for the projector in this manner. Thus, generally, the electro-optical panel used for the projector is driven in a so-called dot-sequential method in which scanning lines are sequentially selected, data lines are sequentially selected one by one in a period in which one scanning line is selected (one horizontal scanning period), the image data is converted into image signals suitable for driving the liquid crystal, and then the converted signals are supplied to the selected data line.

Meanwhile, in recent years, there has been proposed a technique of improving the resolution of a display image. A high-resolution display image can be achieved by increasing the number of scanning lines and the number of data lines. However, in this case, the larger the number of scanning lines is, the shorter one horizontal scanning period becomes. In addition, in the dot-sequential method, the larger the number of data lines is, the shorter the period where the data lines are selected is. Therefore, in the dot-sequential method, it is difficult to secure a sufficient time to supply the image signals to the data lines as the resolution of displayed images improves, which results in insufficient writing of the image signals onto the pixels.

Therefore, in order to solve the problem of insufficient writing, there has been suggested a phase-expansion driving method (see Japanese Unexamined Patent Application Publication No. 2000-112437). In the phase-expansion driving method, blocks each composed of a predetermined number of data lines, for example, six data lines, are simultaneously selected in one horizontal scanning period, and image signals to be supplied to pixels corresponding to the selected scanning line and the selected data lines are expanded in the time axis direction and are then supplied to the six selected data lines, respectively. In the phase-expansion driving method, it is possible to secure a time when the image signals are supplied to the data lines that is six times longer than that in the dot-sequential method. Thus, the phase-expansion driving method is suitable for improving the resolution of a displayed image.

However, when the size of a panel increases, manufacturing costs thereof also increase. Therefore, it is preferable to increase the number of scanning lines and the number of data lines per unit length in order to improve the resolution. In particular, when the number of data lines per unit length increases, an arrangement pitch between the data lines is narrowed, which causes capacitive coupling to easily occur between the data lines. As a result, a voltage variation of a data line has an effect on adjacent data lines, which leads to the deterioration of the display quality.

SUMMARY

An advantage of the invention is that it provides an electro-optical device, a signal processing circuit thereof, a signal processing method thereof, and an electronic apparatus capable of achieving high resolution and of preventing the deterioration of display quality.

According to an aspect of the invention, an electro-optical device includes a plurality of scanning lines that extends in a row direction, a plurality of data lines that extends in a column direction, a plurality of pixels which are provided at intersections of the scanning lines and the data lines and whose gray-scale levels are designated by data signals supplied through the data lines, a common electrode that is provided opposite to each pixel electrode, a shift register that outputs sampling signals to sequentially select a plurality of blocks each composed of a plurality of the data lines, in a period where the scanning lines are selected, a sampling circuit that samples the data signals to the plurality of data lines belonging to the block selected by the sampling signal, respectively, a data signal supply circuit that changes the potential of the data signal into a higher level and a lower level than a predetermined potential in every predetermined period and then alternately outputs the potentials, and a correction circuit that superimposes, on the data signals, correction signals for correcting potential errors that are generated in the data lines belonging to each of the blocks, corresponding to the potentials of the data lines. According to the above-mentioned structure, the data signal corresponding to the gray-scale level is corrected by writing polarity for every designated gray-scale level. Therefore, it is possible to prevent the deterioration of display quality.

Further, it is preferable that the correction circuit include a first translation table that stores correction data indicating a correction amount that is set corresponding to a gray-scale level designated by the data signal having the higher potential, and a second translation table that stores correction data indicating a correction amount that is set corresponding to a gray-scale level designated by the data signal having the lower potential. When these translation tables are provided, it is preferable that, when the correction data corresponding to the gray-scale level designated by the data signal is stored in the first or second translation table, the correction circuit read out the stored correction data, and that, when the correction data corresponding to the gray-scale level designated by the data signal is not stored in the first or second translation table, the correction circuit calculate, from the stored correction data, the correction data corresponding to the gray-scale level designated by the data signal using interpolation. According to the above-mentioned structure, storage capacity required for the translation tables can be reduced.

Furthermore, it is preferable that the correction circuit correct the data signals supplied to the data lines located at boundaries between the blocks.

Moreover, the invention can be applied to a signal processing circuit and a signal processing method of the electro-optical device. In addition, an electronic apparatus according to another aspect of the invention includes the electro-optical device. Therefore, it is possible to achieve an electronic apparatus capable of preventing the deterioration of display quality.

BRIEF DESCRIPTION OF THE DRAWINGS

The invention will be described with reference to the accompanying drawings, wherein like numbers reference like elements, and wherein.

DESCRIPTION OF THE EMBODIMENTS

Figure 1:
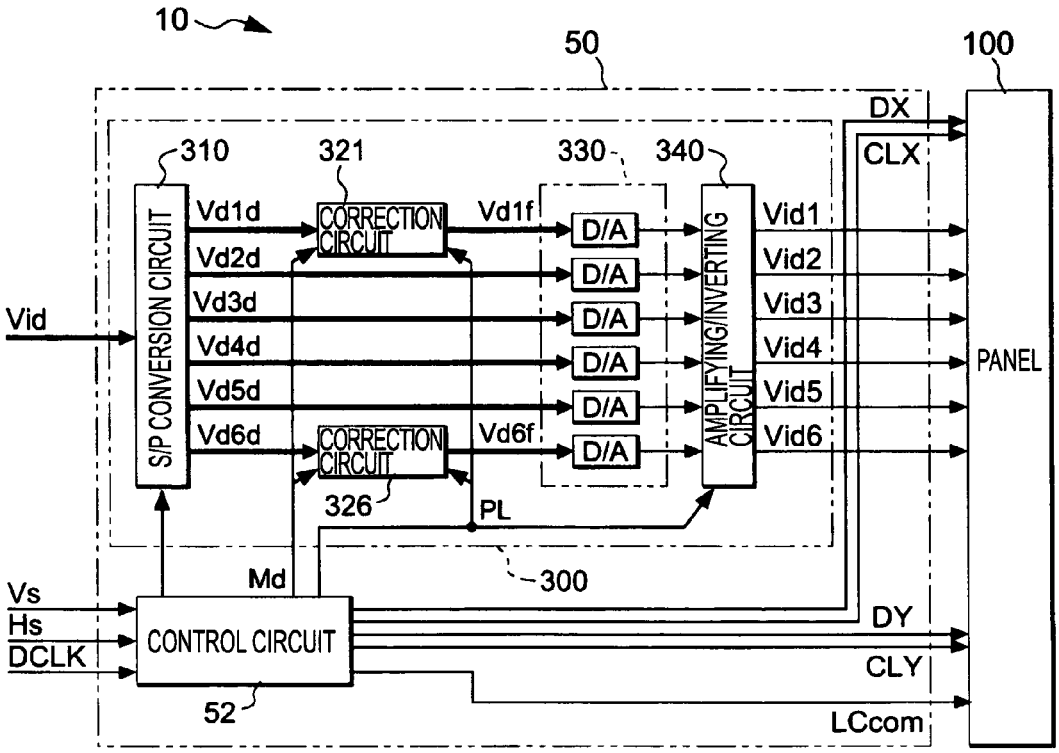
FIG. 1 is a block diagram illustrating the overall structure of an electro-optical device according to an embodiment of the invention.

Hereinafter, preferred embodiments of the invention will be described with reference to the accompanying drawings. FIG. 1 is a block diagram illustrating the overall structure of an electro-optical device according to an embodiment.

As shown in FIG. 1, an electro-optical device 10 has a processing circuit 50 and a panel 100 as main components. The processing circuit 50 is a circuit module formed on a printed circuit board, and is connected to the panel 100 by, for example, a flexible printed circuit (FPC) board.

The processing circuit 50 includes a data signal supply circuit 300 and a control circuit 52, and the data signal supply circuit 300 has an S/P conversion circuit 310, correction circuits 321 and 326, a D/A conversion circuit group 330, and an amplifying/inverting circuit 340.

The S/P conversion circuit 310 synchronizes with a vertical scanning signal Vs, a horizontal scanning signal Hs, and a dot clock signal DCLK and distributes digital image data Vid supplied from an upper-level device (not shown) into six channels. Then, the S/P conversion circuit 310 expands the distributed data six times along the time axis (which is called phase 'expansion' or 'serial-parallel conversion') to output image data Vd1d to Vd6d. For the convenience of explanation, the image data Vd1d to Vd6d are respectively referred to as channels 1 to 6.

Here, the image data Vid is data that designates the brightness of a pixel as a gray-scale value in a horizontal effective display period and that designates the brightness of the pixel at the lowest gray-scale level (black) in a horizontal retrace period.

The reason why the brightness of a pixel is designated at the lowest gray-scale level in the horizontal retrace period is that, even if the image data Vid is supplied to a pixel, the pixel does not contribute to display. In addition, the image data Vid is S/P converted in order to prolong the time for which data signals are applied at a sampling switch, which will be described later, and to secure a sampling/holding time and a charging/discharging time.

The correction circuit 321 corrects the image data Vd1d of the channel 1, corresponding to the gray-scale value for every writing polarity, to output the corrected data as image data Vd1f. The correction circuit 326 corrects the image data Vd6d of the channel 6, corresponding to the gray-scale value for every writing polarity, to output the corrected data as image data Vd6f. The detailed structure of the correction circuits 321 and 326 will be described later.

The D/A conversion circuit group 330 is a group of D/A converters provided at the respective channels, and converts the image data Vd1f, Vd2d to Vd5d, and Vd6f into analog voltage signals corresponding to gray-scale values thereof, respectively.

The amplifying/inverting circuit 340 inverts the polarities of the converted analog signals or returns the polarities thereof to the original state on the basis of a voltage Vc, as described later, to supply the analog signals to the panel 100 as data signals Vid1 to Vid6.

The polarity inversion can be performed (a) for every scanning line, (b) for every data signal line, (c) for every pixel, and (d) for every frame. In this embodiment, the polarity inversion is performed (a) for every scanning line. However, the invention is not limited thereto.

Figure 7:
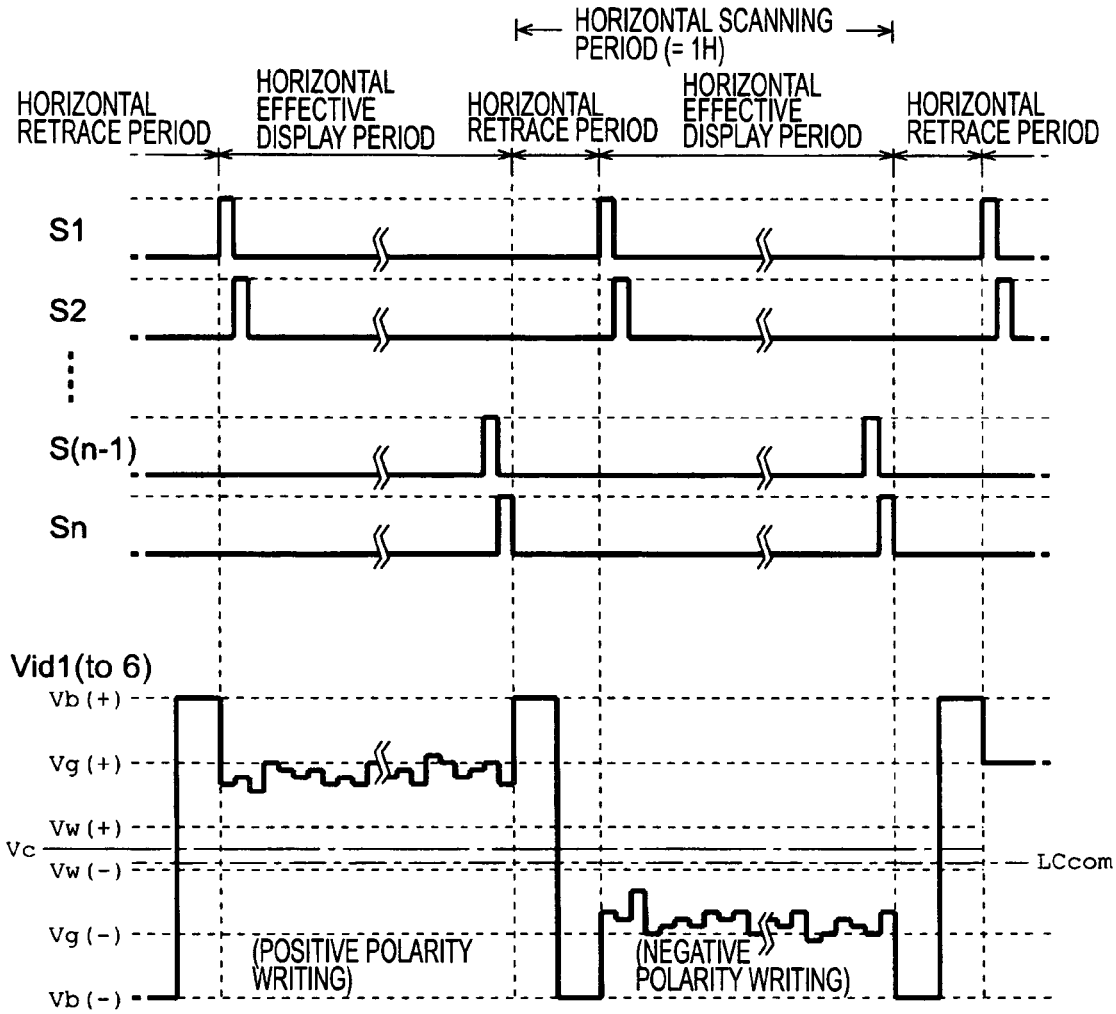
FIG. 7 is a timing chart illustrating the operation of the electro-optical device.

Further, the voltage Vc is an intermediate voltage of the amplitude of an image signal, as shown in FIG. 7. In addition, in the present embodiment, for the sake of convenience, a voltage higher than an intermediate voltage vc in amplitude is referred to as a positive voltage, and a voltage lower than the intermediate voltage vc is referred to as a negative voltage.

In the present embodiment, first, serial-to-parallel conversion is performed on the image data Vid, and then analog conversion is performed thereon. However, analog conversion may be performed on the image data Vid first, and then serial-to-parallel conversion may be performed thereon.

Figure 2:
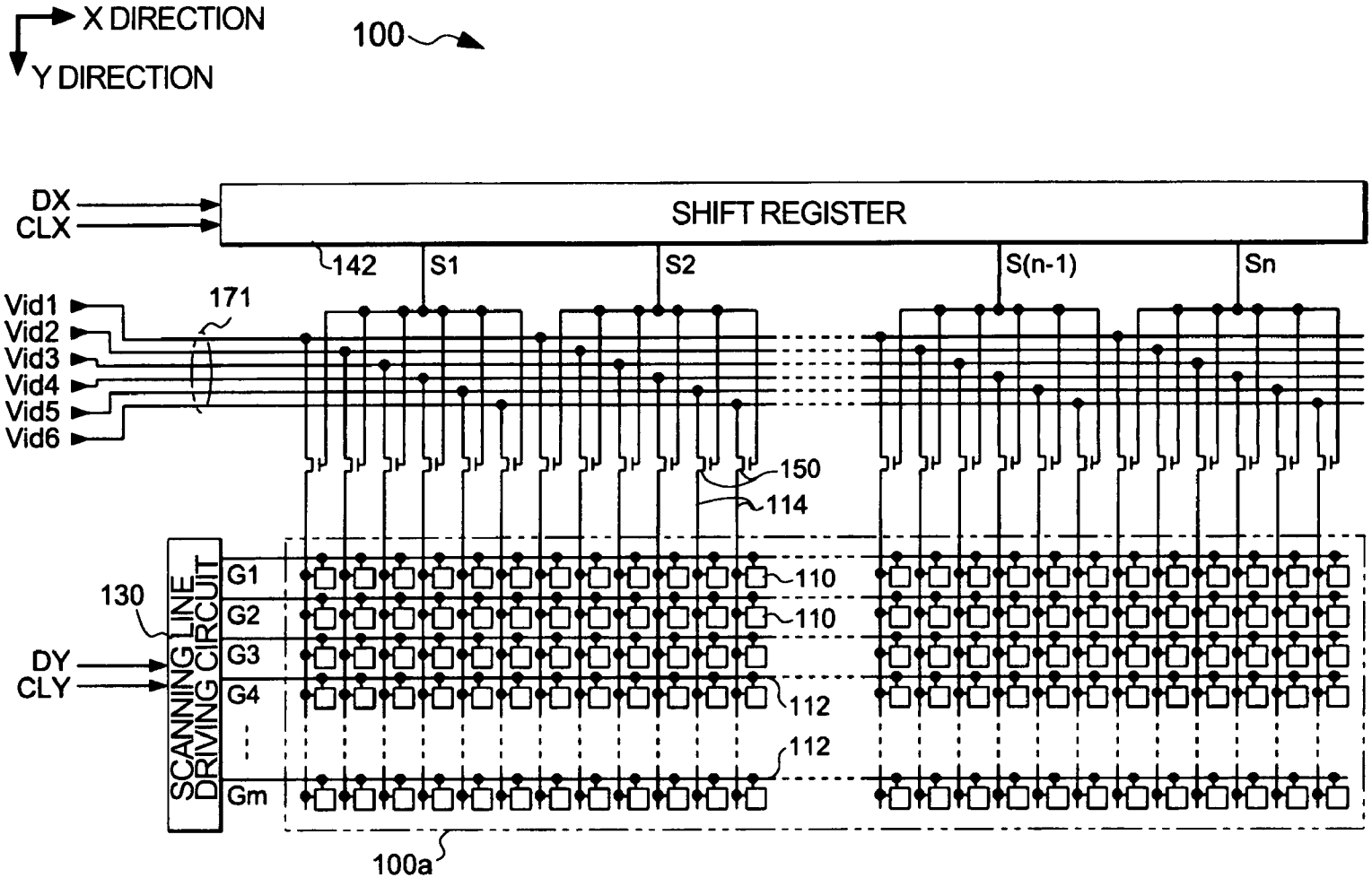
FIG. 2 is a view illustrating the structure of an electro-optical panel of the electro-optical device.
Figure 3:
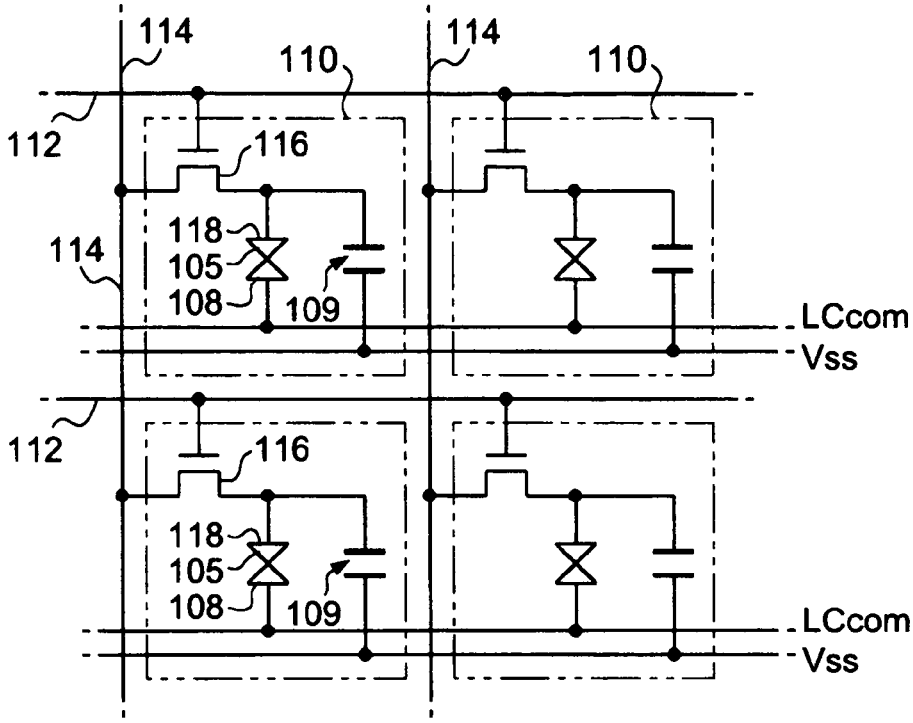
FIG. 3 is a view illustrating the structure of pixels of the electro-optical panel.

Hereinafter, the structure of the panel 100 will be described. The panel 100 functions to form a predetermined image by electro-optical modulation. FIG. 2 is a block diagram illustrating the electrical structure of the panel 100, and FIG. 3 is a view illustrating the detailed structure of pixels of the panel 100.

As shown in FIG. 2, in the panel 100, a plurality of scanning lines 112 extends in the horizontal direction (the row direction, the X direction), and a plurality of data lines 114 extends in the vertical direction (the column direction, the Y direction). In addition, pixels 110 are provided so as to respectively correspond to intersections of the plurality of scanning lines 112 and the plurality of data lines 114, thereby constituting a display region 100*a*.

In the present embodiment, it is assumed that the number of scanning lines 112 (the number of rows) is 'm', that the number of data lines (the number of columns) is '6n' (a multiple of 6), and that the pixels 110 are arranged in a matrix of m rows by 6n columns.

The data signals Vid1 to Vid6 are supplied from the amplifying/inverting circuit 340 to six image signal lines 171, respectively.

A sampling switch 150 is connected to one end of each of the data lines 114 to sample the respective data signals Vid1 to Vid6 supplied to the image signal lines 171 to the data lines 114. Each sampling switch 150 is an n-channel-type thin film transistor (hereinafter, referred to as a TFT) whose drain is connected to the data line 114. In addition, gates of the sampling switches 150 corresponding to every six data lines 114 are commonly connected.

Herein, it is considered that the data lines 114 to which the sampling switches 150 whose gates are connected to each other are connected belong to one block. In one block of data lines, the sampling switch 150 whose drain is connected to one end of a j-th data line 114 from the left side of FIG. 2 has a source connected to the image signal line 171 to which the data signal Vid1 is supplied when j is divisible by 6 with a remainder of 1. Similarly, when j is divisible by 6 with a remainder of 2, 3, 4, 5, and 0, respectively, the sampling switches 150 whose drains are connected to the other data lines 114 have sources respectively connected to the image signal lines 171 to which the data signal Vid2, Vid3, Vid4, Vid5, and Vid6 are supplied. For example, the sampling switch 150 whose drain is connected to an eleventh data line 114 from the left side of FIG. 2 has a source connected to the image signal line 171 to which the data signal Vid5 is supplied since 11 is divided by 6 with a remainder of 5. Herein, the letter j is used as an example of the number of data line 114, and is an integer satisfying $1 \leqq j \leqq 6n$.

Figure 6:
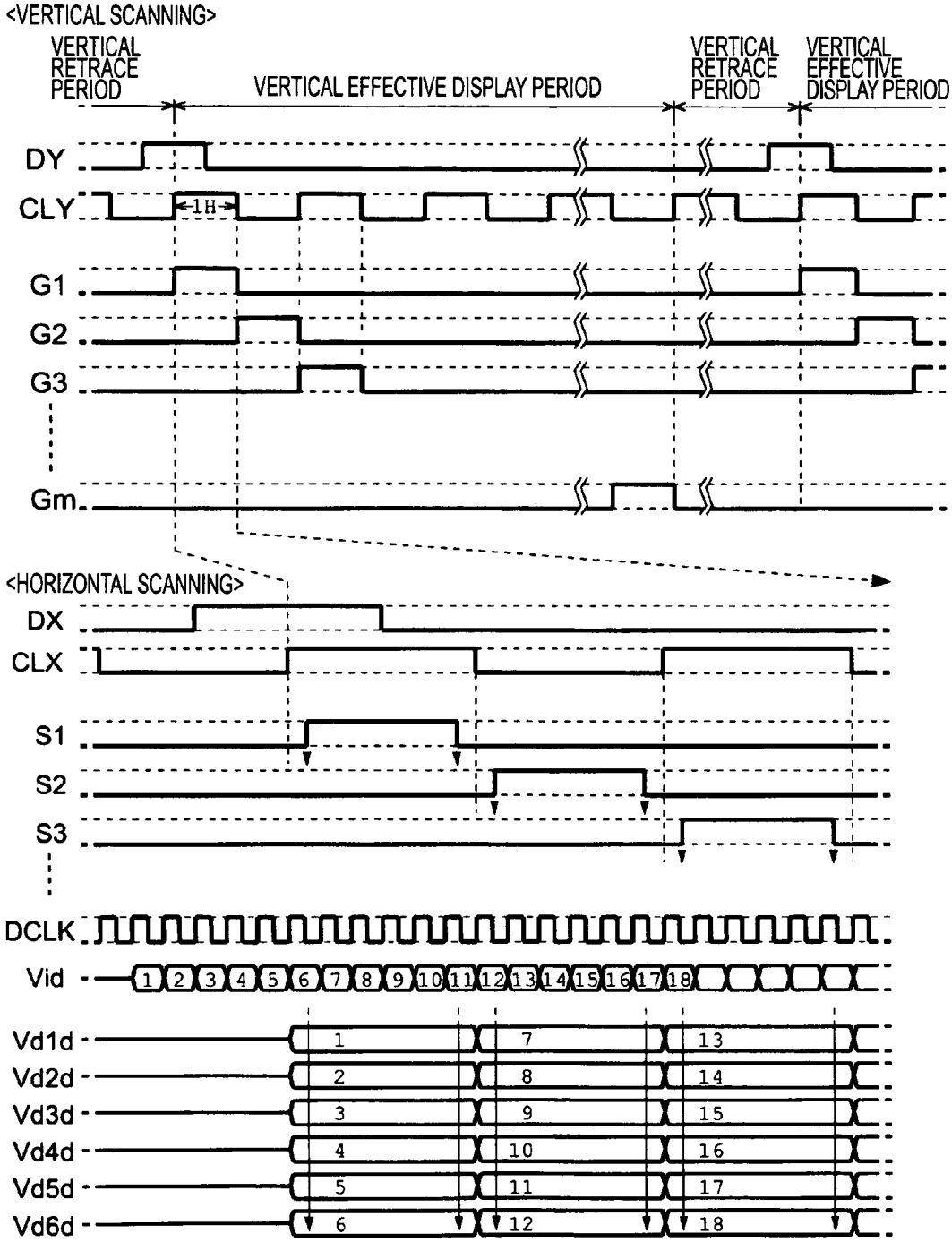
FIG. 6 is a timing chart illustrating the operation of the electro-optical device.

As shown in FIG. 6, a scanning line driving circuit 130 receives and sequentially shifts a transmission starting pulse DY supplied at the beginning of a vertical effective display period at the timing when the level of a clock signal CLY is changed (rise or fall), and then sequentially and exclusively outputs them as scanning signals G1, G2, . . . , Gm whose level is high only in a horizontal scanning period (1H). In addition, the detailed description of the scanning line driving circuit 130 will be omitted since it is not directly concerned with the invention.

Further, as shown in FIG. 6, a shift register 142 receives and sequentially shifts a transmission starting pulse DX supplied at the beginning of a horizontal effective display period at the timing when the level of a clock signal CLX is changed, and then narrows the pulse width thereof to output them as sampling signals S1, S2, S3, S(n−1), Sn. In addition, a detailed description of the shift register 142 will be omitted since it is not directly concerned with the invention.

These sampling signals S1, S2, S3, . . . , Sn are commonly supplied to the sampling switches corresponding to the blocks of data lines 114, as shown in FIG. 2. For example, since a second block from the left side corresponds to the seventh to twelfth data lines 114, the sampling signal S2 is commonly supplied to the gates of the sampling switches 150 corresponding to these data lines 114.

Furthermore, in the present embodiment, the TFT constituting each sampling switch 150 is of an n-channel type. However, the TFT may be of a p-channel type or a complementary type formed by integrating both types.

Next, the pixel 110 will be described.

As shown in FIG. 3, in each pixel 110, a source of an n-channel TFT 116 is connected to the data line 114, and a drain thereof is connected to a pixel electrode 118. In addition, a gate thereof is connected to the scanning line 112.

Further, a common electrode 108 is provided common to all pixels so as to be opposite to the pixel electrodes 118, and is maintained at a voltage LCcom supplied from a control circuit 52. A liquid crystal layer 105 is interposed between the pixel electrodes 118 and the common electrode 108. Therefore, a liquid crystal capacitor composed of the pixel electrode 118, the common electrode 108, and the liquid crystal layer 105 is formed in each pixel.

Although not particularly shown in the drawings, alignment films on which a rubbing process is performed such that the major axes of liquid crystal molecules are continuously twisted at an angle of 90° are provided on surfaces of two substrates opposite to each other, respectively, and polarizers are provided on the other surfaces of the two substrates along the alignment direction, respectively.

When an effective voltage value applied to the liquid crystal capacitor is zero, light passing between the pixel electrode 118 and the common electrode 108 is rotated by about 90° along the twisted liquid crystal molecules. In this state, with an increase in the effective voltage value, the liquid crystal molecules are inclined in the direction of an electric field, which results in the disappearance of optical rotation. Therefore, for example, in a transmissive liquid crystal device, in a case in which polarizers having polarizing axes perpendicular to each other along the alignment direction are provided on an incident side and a rear side, respectively, when the effective voltage value is approximately zero, the maximum transmittance of light is obtained, resulting in white display. However, with an increase in the effective voltage value, the transmittance is reduced to the minimum value, resulting in black display (a normally white mode).

Further, in order to prevent the leakage of charge from the liquid crystal capacitor, a storage capacitor 109 is provided in each pixel. One end of each storage capacitor 109 is connected to the pixel electrode 118 (the drain of the TFT 116), and the other end thereof is connected to the ground, which is commonly applied to all storage capacitors.

Furthermore, the TFTs 116 of the pixels 110 are formed in the same manufacturing process as that in which components constituting the scanning line driving circuit 130, the shift register 142, and the sampling switches 150 are formed, which contributes to a reduction in the size and manufacturing costs of a device.

Referring to FIG. 1 again, the control circuit 52 generates the transmission starting pulse DX and the clock signal CLX from the dot clock signal DCLK, the vertical scanning signal Vs, and the horizontal scanning signal Hs supplied from an upper-level device to control the horizontal scanning by the shift register 142, and generates the transmission starting pulse DY and the clock signal CLY therefrom to control the vertical scanning by the scanning line driving circuit 130.

Further, the control circuit 52 controls the phase expansion of the S/P conversion circuit 310 in synchronization with the horizontal scanning, and outputs a signal PL for designating a writing polarity and a signal Md for designating a mode.

Herein, the present embodiment includes a display mode, which is a normal display mode, and an adjustment mode. In the adjustment mode, the control circuit 52 allows the voltage LCcom applied to the common electrode 108 to be changed between a voltage higher than that in the display mode and a voltage lower than that in the display mode. In addition, the voltage LCcom in the display mode is set lower than the voltage Vc, which is the standard of polarity inversion.

Furthermore, the amplifying/inverting circuit 340 returns the polarity of the analog signal converted by the D/A conversion circuit group 330 to the original state when positive polarity writing is designated by the signal PL, and inverts the polarity thereof when negative polarity writing is designated by the signal PL. Then, the amplifying/inverting circuit 340 outputs the results as the data signals Vid1 to Vid6, respectively.

Next, the operation of the electro-optical device 10 will be described. The present embodiment is characterized by the correction circuit 321 (326). Therefore, first, it will be described what kind of problem arises in a case in which the correction circuit 321 (326) is not provided. Then, it will be described how the problem is settled in a case in which the correction circuit 321 (326) is provided.

First, the operation of the electro-optical device 10 will be described when the correction circuit 321 (326) is not provided, that is, when the image data Vd1d to Vd6d is D/A converted. FIG. 6 is a timing chart illustrating a vertical scanning operation and a horizontal scanning operation in the electro-optical device 10, and FIG. 7 is a timing chart illustrating an example of the voltage waveforms of data signals supplied over the continuous horizontal scanning period.

The transmission starting pulse DY is supplied to the scanning line driving circuit 130 at the beginning of the vertical effective display period. As shown in FIG. 6, this supply causes the scanning signals G1, G2, G3, . . . , Gm to sequentially and exclusively turn to H levels and then to be output to the respective scanning lines 112. First, the horizontal scanning period in which the scanning signal G1 is at the H level will be described.

The horizontal scanning period is divided into a horizontal retrace period and a horizontal effective display period following the horizontal retrace period. In the horizontal effective display period, the image data Vid supplied in synchronization with the horizontal scanning is first distributed into six channels by the S/P conversion circuit 310, and the distributed data is expanded six times along the time axis. Then, second, the expanded signals are converted into analog signals by the D/A conversion circuit group 330. Third, the polarities of the analog signals are returned to their original states by the amplifying/inverting circuit 340 on the basis of the voltage Vc, corresponding to the positive polarity writing. Therefore, the voltages of the data signals Vid1 to Vid6 by the amplifying/inverting circuit 340 become higher than the voltage Vc as the gray-scale level of an image is lowered.

Meanwhile, as shown in FIG. 6, in the horizontal effective display period where the scanning signal G1 is at the H level, the shift register 142 fetches the transmission starting pulse DX using the clock signal CLX and sequentially shifts the signal to output the sampling signals S1, S2, S3, . . . , Sn having narrow pulse widths.

Herein, in the horizontal effective scanning period where the scanning signal G1 is at the H level, when the sampling signal S1 turns to an H level, the corresponding data signals Vid1 to Vid6 are respectively sampled to six data lines 114 belonging to the first block from the left side. Then, the sampled data signals Vid1 to Vid6 are applied to the pixel electrodes 118 of the pixels located at the intersections of the first scanning line 112 from the upper side of FIG. 2 and these six data lines 114 (the first to sixth data lines from the left side).

Thereafter, when the sampling signal S2 turns to an H level, the corresponding data signals Vid1 to Vid6 are respectively sampled to six data lines 114 belonging to the second block, and then these data signals Vid1 to Vid6 are applied to the pixel electrodes 118 of the pixels located at the intersections of the first scanning line 112 and the six data lines 114 (seventh to twelfth data lines from the left side).

Similarly, when the sampling signals S3, S4, . . . , S(n−1), Sn sequentially become H levels, the corresponding data signals Vid1 to Vid6 are sequentially sampled to six data lines 114 belonging to each of the third, fourth, . . . , n-th blocks, and these data signals Vid1 to Vid6 are respectively applied to the pixel electrodes 118 of the pixels located at the intersections of the first scanning line 112 and the six data lines 114. In this way, the writing of signals onto a first row of pixels is completed. Then, even if the scanning signal G1 becomes an L level to turn off the TFT 116, the written voltage is held by the liquid crystal capacitor or the storage capacitor 109.

Subsequently, the period where the scanning signal G2 is at an H level will be described. In the present embodiment, as described above, since polarity inversion is performed on each scanning line, negative polarity writing is performed in the horizontal effective display period.

In the meantime, the image data Vid causes a pixel to appear to be black in the horizontal retrace period, but the positive polarity writing is performed in the previous horizontal effective display period. Therefore, when the data signals Vid1 to Vid6 are applied to the pixel electrode 118 of the pixels 110 substantially at the intermediate timing of this horizontal retrace period, as shown in FIG. 7, positive voltages Vb(+) thereof that cause the corresponding pixels to have the lowest gray-scale levels (black) are switched to negative voltages Vb(−) that cause the corresponding pixels to have the lowest gray-scale levels (black).

In addition, the relationship between voltages is described with reference to FIG. 7. When voltages Vw(−) and Vg(−), which are negative voltages, are applied to the pixel electrodes 118 of the pixels 110, the voltage Vw(−) causes the pixel to have the highest gray-scale level (white), and the voltage Vg(−) causes the pixel to have a middle gray-scale level (ash color). Meanwhile, voltages Vw(+) and Vg(+), which are positive voltages, are applied to the pixel electrodes 118 of the pixels 110, the voltage Vw(+) causes the pixel to have the highest gray-scale level (white), and the voltage Vg(+) causes the pixel to have a middle gray-scale level (ash color). In addition, the voltages Vw(+) and Vg(+) are symmetrical with the voltages Vw(−) and Vg(−), respectively, with respect to the voltage Vc.

The operation in the horizontal effective display period where the scanning signal G2 is at the H level is the same as that in the horizontal effective display period where the scanning signal G1 is at the H level. That is, the sampling signals S1, S2, S3, . . . , Sn sequentially become H levels, and thus the writing of the signals on a second row of pixels is completed. However, since the negative polarity writing is performed in the horizontal effective display period where the scanning signal G2 is at the H level, the amplifying/inverting circuit 340 inverts the polarities of the expanded signals having six channels on the basis of the voltage Vc, corresponding to the negative polarity writing and then outputs the polarity-inverted signals. Therefore, the voltages of the data signals Vid1 to Vid6 become lower than the voltage Vc as the gray-scale level of a pixel becomes lower, as shown in FIG. 7.

Similarly, the scanning signals G3, G4, . . . , Gm sequentially become H levels, so that the writing of signals on the third, fourth, . . . , m-th rows of pixels is completed. In this way, the positive polarity writing is performed on odd rows of pixels, while the negative polarity writing is performed on even rows of pixels. Thus, in one vertical scanning period, the writing of signals on the first to m-th rows of pixels is completed.

In addition, when the data signals Vid1 to Vid6 shift from the horizontal effective display period for the positive polarity writing to the horizontal effective display period for the negative polarity writing substantially at the intermediate timing of the horizontal retrace period, the voltages Vb(+) thereof are switched to the voltage Vb(−). On the other hand, when the data signals Vid1 to Vid6 shift from the horizontal effective display period for the negative polarity writing to the horizontal effective display period for the positive polarity writing substantially at the intermediate timing of the horizontal retrace period, the voltages Vb(−) thereof are switched to the voltage Vb(+).

Further, the same writing is performed in the next vertical scanning period. However, at that time, writing polarities on each row of pixels are changed. That is, in the next vertical scanning period, the negative writing is performed on odd rows of pixels, and the positive writing is performed on even rows of pixels.

In this way, since the writing polarities on the pixels are changed for every vertical scanning period, direct current components are not applied to the liquid crystal layer 105, which prevents the deterioration of the liquid crystal layer 105.

As described above, in the present embodiment, in the display mode, the voltage LCcom applied to the common electrode 108 is set lower than the voltage Vc, which is the standard of polarity inversion. This is because the pushdown effect of the TFT constituting the sampling switch 150 is considered. The pushdown effect is a phenomenon in which a voltage held at the drain of a TFT is lowered when a gate voltage (sampling signal) of the TFT is changed from an H level to an L level (from an ON state to an OFF state). This is particularly caused by the parasitic capacitance between the gate and the source, and this phenomenon becomes more remarkable as the source voltage becomes lower.

Figure 8:
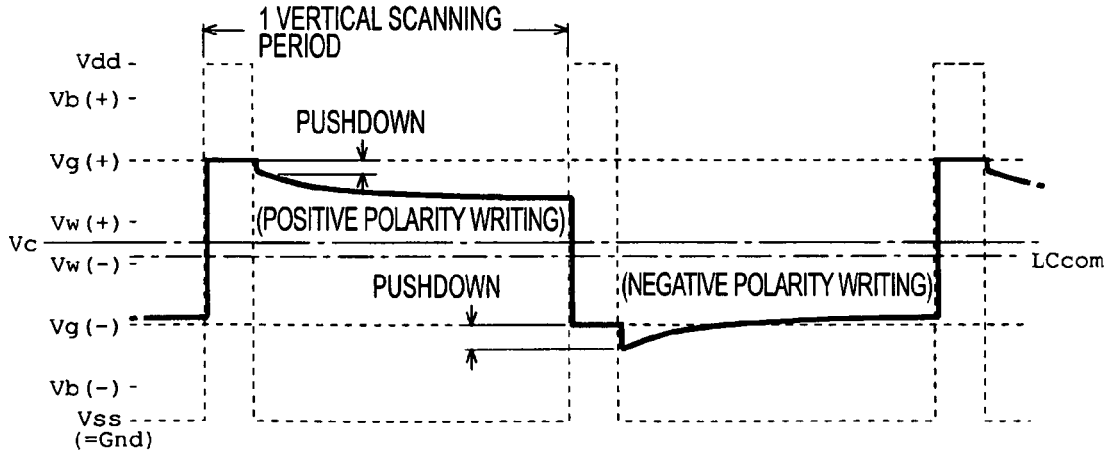
FIG. 8 is a view illustrating pushdown.

This effect of the pushdown is exemplified in a waveform. For example, in order to make a pixel have an ash color, when the voltages Vg(+) and Vg(−) are alternately written as data signals in every vertical scanning period, the voltage waveform of the pixel electrode 118 of the pixel is as shown in FIG. 8.

The TFT 116 is turned on in one horizontal scanning period where the pixel is selected, but the sampling switch 150 of the data line corresponding to the pixel is turned on only in a portion of the horizontal scanning period where a block is selected. In other words, the sampling switch 150 is turned on in the middle of the horizontal scanning period. Therefore, a data signal sampled to the data line 114 is influenced by the pushdown at the time when the sampling switch 150 is turned on. As shown in FIG. 8, the amount of pushdown immediately after the positive voltage vg(+) corresponding to gray is written is greater than that immediately after the negative voltage Vg(−) corresponding to gray is written.

When the voltage Vc, which is the standard of polarity inversion, is applied to the common electrode 108, direct current components are applied to the liquid crystal capacitor since the effective voltage of the liquid crystal capacitor is greater in the positive polarity writing than in the negative polarity writing. In order to solve the above-mentioned problem, the voltage LCcom applied to the common electrode 108 is set lower than the voltage Vc so that the effective voltage values applied to the liquid crystal capacitor are equal to each other even if the amounts of pushdown with respect to each polarity are different from each other.

Herein, when voltages that are symmetric with respect to the voltage Vc are written in the positive polarity writing and the negative polarity writing, the voltage LCcom that makes the effective voltages of two polarities equal to each other is referred to as an optimum voltage LCcom.

Meanwhile, when the data lines 114 have narrow arrangement pitches as described above, the capacitive coupling between adjacent data lines increases.

Figure 9:
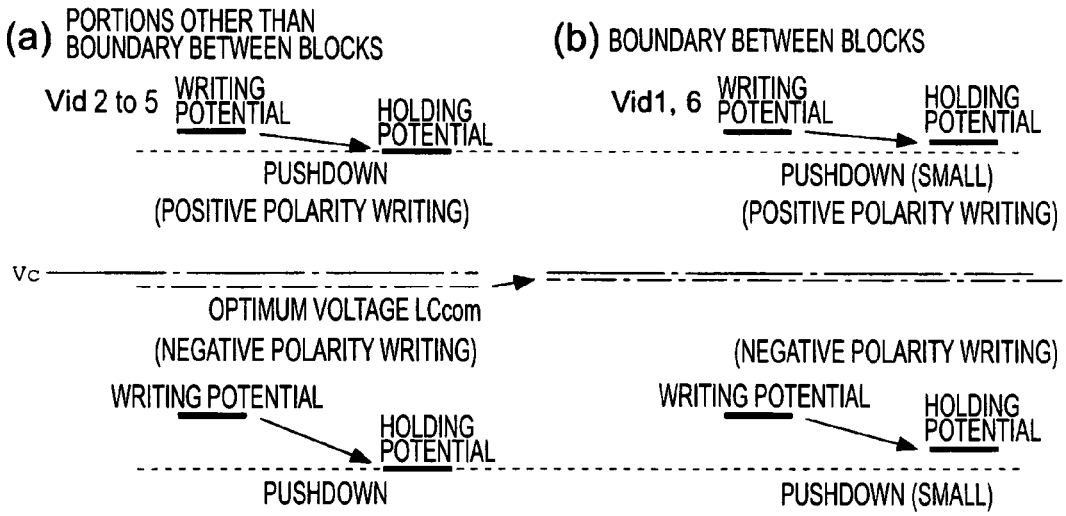
FIGS. 9A and 9B are views illustrating a variation in the holding voltage of a data line caused by a difference in pushdown.

In the present embodiment, a phase-expansion driving method is adopted in which each block is composed of six data lines and then one of the data lines is selected. In this phase-expansion driving method, in a case in which a certain block is selected, when a variation in voltage occurs in data lines (data lines corresponding to the channels 2 to 5) in portions other than the boundaries between blocks (when data signals are sampled), the variation in voltage also occurs in data lines adjacent to both sides. On the contrary, when a variation in voltage occurs in data lines (data lines corresponding to the channels 1 and 6) at the boundaries between blocks, the variation in voltage occurs in a data line adjacent to one side, but does not occurs in a data line adjacent to the other side. Therefore, this is equivalent to increasing additional capacitance, and the amount of pushdown decreases in the data lines located at the boundaries between blocks, compared to the data lines in the portions other than the boundaries between blocks (see FIGS. 9A and 9B).

Therefore, the pixels located at the boundaries between blocks are different from each other in the effective voltage value of the liquid crystal capacitor, compared to those in portions other than the boundaries between blocks. Thus, the gray-scale levels of the pixels located at the boundaries between blocks are different from those of the pixels in portions other than the boundaries between blocks although display is performed at the same gray-scale level. Here, since the difference between the gray-scale levels of pixels occurs at the boundaries between blocks, longitudinal stripes appear in the display region 100*a*.

Therefore, a method of getting rid of these longitudinal stripes is examined. As described above, the generation of these longitudinal stripes is mainly caused by the difference between the amount of pushdown of data lines located at the boundaries between blocks and the amount of pushdown of data lines in portions other than the boundaries between blocks. Therefore, it is preferable to make voltages that are being finally held (after pushdown) equal to each other even if the amount of pushdown of data lines located at the boundaries between blocks is different from the amount of pushdown of data lines in portions other than the boundaries between blocks. In order to achieve this structure, the following two methods are assumed.

That is, according to a first method, image data (or data signals) is corrected such that a voltage which is finally held in data lines in portions other than the boundaries between blocks is equal to a voltage which is finally held in data lines at the boundaries between blocks. On the other hand, according to a second method, the image data (or the data signals) is corrected such that the voltage which is finally held in the data lines at the boundaries between blocks is equal to the voltage which is finally held in the data lines in the portions other than the boundaries between blocks.

In the first method, it is necessary to readjust the voltage LCcom, in addition to correcting the major data signals of the channels 2 to 5. Therefore, the present embodiment adopts the second method.

The second method is realized by the correction circuits 321 and 326 shown in FIG. 1. The correction circuit 321 corrects the image data Vd1d such that a voltage which is finally held in data lines corresponding to the channel 1 located at the boundaries between blocks is equal to a voltage which is finally held in data lines corresponding to the channels 2 to 5 in portions other than the boundaries between blocks. The correction circuit 326 corrects the image data Vd6d such that a voltage which is finally held in data lines corresponding to the channel 6 located at the boundaries between blocks is equal to a voltage which is finally held in the data lines corresponding to the channels 2 to 5 in portions other than the boundaries between blocks.

The correction circuits 321 and 326 have substantially the same structure, and thus only the correction circuit 321 will be described in detail with reference to FIG. 4.

Figure 4:
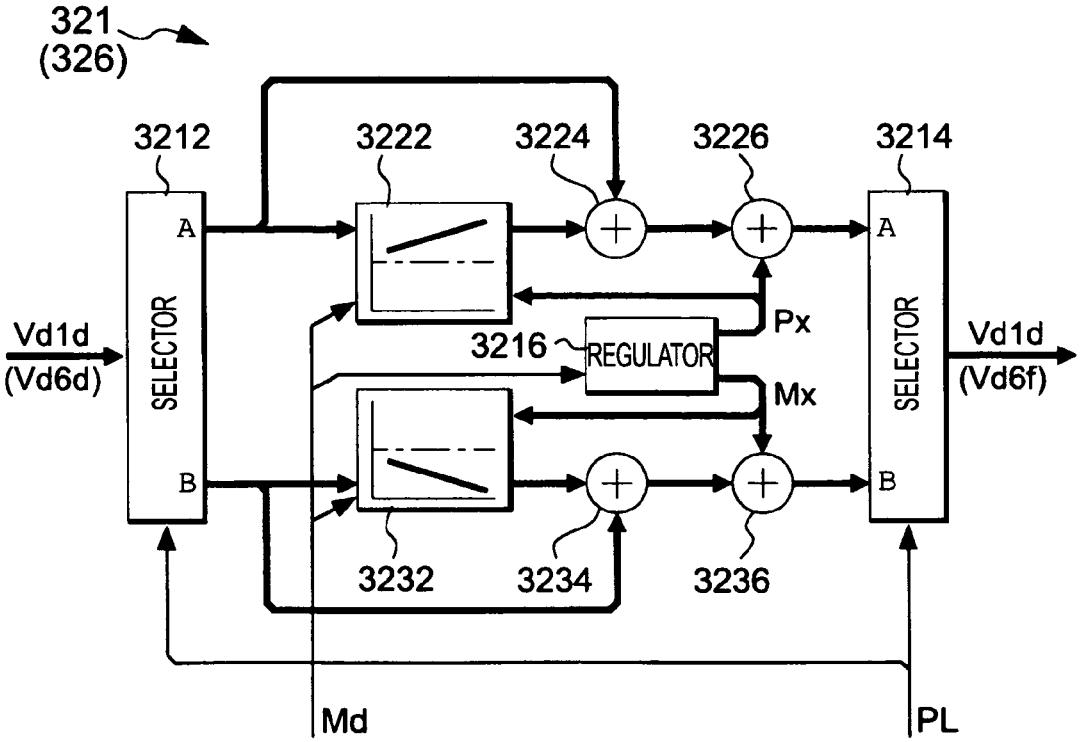
FIG. 4 is a view illustrating the structure of a correction circuit of the electro-optical device.

In FIG. 4, a selector (demultiplexer) 3212 selects an output terminal A when positive polarity writing is designated by the signal PL, and selects an output terminal B when negative polarity writing is designated by the signal PL. Then, the selector 3212 selects the phase-expanded image data Vd1d and then outputs it to the output terminal.

A translation table (first translation table) 3222 corresponds to the positive polarity writing, and is stored with correction data for each gray-scale value that is designated by the image data. Here, the translation table 3222 reads out correction data corresponding to the gray-scale value designated by the image data and then outputs it when the display mode is designated by the signal Md. On the other hand, when the adjustment mode is designated by the signal Md, the translation table 3222 outputs correction data having a correction amount of zero regardless of stored contents and changes correction data corresponding to a certain gray-scale value to adjustment data Px output from a regulator 3216, which will be described later.

When the correction data stored in the translation table 3222 is added to the image data Vd1d in the positive polarity writing and then the data signal Vid1 is output based on the added data, the correction data makes the voltage that is finally held in the data lines of the channel 1 equal to the voltage that is finally held in the data lines of the channels 2 to 5.

An adder 3224 adds the image data Vd1d output from the selector 3212 to the correction data output from the translation table 3222 and then outputs the added data.

Further, when the adjustment mode is designated by the signal Md, the regulator 3216 generates adjustment data Px for the positive polarity and adjustment data Mx for the negative polarity and then outputs the data under the control of the control circuit 52. On the other hand, when the display mode is designated by the signal Md, the regulator 3216 outputs zero data as the adjustment data Px and Mx.

An adder 3226 adds the added data by the adder 3224 and the adjustment data Px output from the regulator 3216 and then supplies the added data to an input terminal A of a selector 3214.

Meanwhile, a translation table (second translation table) 3232 corresponds to the negative polarity writing, and is stored with correction data for each gray-scale value that is designated by the image data. Here, the translation table 3232 reads out correction data corresponding to the gray-scale value designated by the image data and then outputs it when the display mode is designated by the signal Md. On the other hand, when the adjustment mode is designated by the signal Md, the translation table 3232 outputs correction data having a correction amount of zero regardless of stored contents and changes correction data corresponding to a certain gray-scale value to adjustment data Mx output from the regulator 3216, which will be described later.

An adder 3234 adds the image data Vd1d output from the selector 3212 and the correction data output from the translation table 3232, and then outputs the added data. An adder 3236 adds the added data by the adder 3234 and the adjustment data Mx output from the regulator 3216, and then supplies the added data to an input terminal B of the selector 3214.

A selector (demultiplexer) 3214 selects an input terminal A when the positive polarity writing is designated by the signal PL, and selects an input terminal B when the negative polarity writing is designated by the signal PL. Then, the selector 3212 supplies the data supplied to the selected input terminal as the corrected image data Vd1d.

Further, the correction circuit 326 corresponding to the channel 6 has the same structure as that in FIG. 4.

For the convenience of explanation, the operation of the adjustment mode will be described. The adjustment mode is a mode for storing and updating the correction data corresponding to gray-scale values in the translation tables 3222 and 3224. In the adjustment mode, for example, a CCD camera is provided on a display surface of the panel 100 to perform an imaging process on a screen to be actually displayed and to test it (the structure thereof is not shown in FIG. 4). In addition, in the adjustment mode, first to fourth operation steps are repeatedly performed on gray-scale values $K_4$, $K_8$, and $K_{12}$, respectively.

Figure 5A:
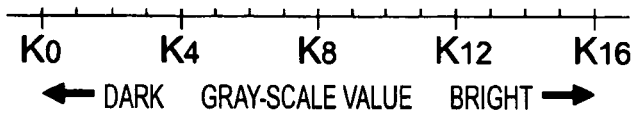
FIGS. 5A to 5C are views illustrating contents of correction in the correction circuit.

Further, in the present embodiment, as shown in FIG. 5A, it is assumed that the lowest gray-scale level (black) of a pixel has a gray-scale value $K_0$, that the highest gray-scale level (white) of a pixel has a gray-scale value $K_{16}$, and that gray-scale values $K_1$ to $K_{15}$ exist between the gray-scale values $K_0$ and $K_{16}$. Therefore, a gray-scale level corresponding to a gray-scale value $K_8$ is a middle gray-scale level between the highest gray-scale level and the lowest gray-scale level. In addition, a gray-scale value $K_4$ corresponds to a middle gray-scale level between the gray-scale value $K_8$ and the lowest gray-scale level, and a gray-scale value $K_{12}$ corresponds to the middle gray-scale level between the gray-scale value $K_8$ and the highest gray-scale level.

Next, the first to fourth steps for the gray-scale value $K_8$ will be described. In the first to fourth steps for the gray-scale value $K_8$, the image data Vid supplied from an upper-level device is composed of data for designating all pixels at the gray-scale level corresponding to the gray-scale value $K_8$.

In the first step, the control circuit 52 controls the regulator 3216 of the correction circuit 321 (326) to set the values of the adjustment data Px and Mx to be zero.

In the correction circuit 321 (326), when the positive polarity writing is designated by the signal PL, the selector 3212 selects the output terminal A, and the selector 3214 selects the input terminal A. Therefore, the image data Vd1d passes through the translation table 3222 and the adders 3224 and 3226. However, in the adjustment mode, since zero data is output from the translation table 3222 regardless of the gray-scale level designated by the image data Vid, the added result by the adder 3224 is the phase-expanded image data Vd1d. Further, in the adjustment mode, the adder 3226 adds the adjustment data Px and the image data Vd1d obtained by the adder 3224, and then outputs the added data to the input terminal A of the selector 3214. However, in this step, since the adjustment data Px is zero, the image data Vd1d is input to the input terminal A of the selector 3214.

Meanwhile, when the negative polarity writing is designated by the signal PL, the selector 3212 selects the output terminal B, and the selector 3214 selects the input terminal B. Therefore, the image data Vd1d passes through the translation table 3232 and the adders 3234 and 3236. Then, the image data Vd1d is supplied to the input terminal B of the selector 3214, similarly to the case in which the positive polarity writing is designated.

Figure 10A:
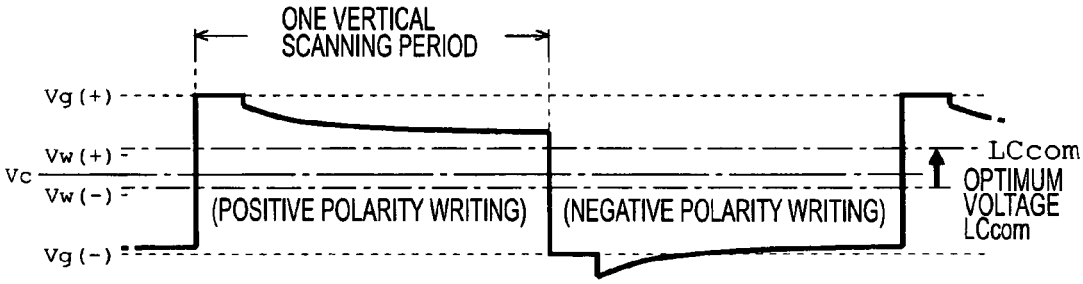
FIGS. 10A and 10B are views illustrating the shift of a voltage LCcom in first and third steps.

Further, in the first step, since corrected image data Vd1f (Vd6f) output from the selector 3214 is the image data Vd1d (Vd6d), a voltage waveform applied to the pixel electrodes 118 of the respective pixels is as shown in FIG. 10A. That is, the voltage waveform shown in FIG. 10A is the same as that in FIG. 8. In FIG. 10A, the gray-scale value $K_8$ corresponds to a data signal voltage Vg(+) in the positive polarity, and corresponds to a data signal voltage Vg(−) in the negative polarity.

Furthermore, in the first step, the control circuit 52 shifts the voltage LCcom to be applied to the common electrode 108 to a higher level than the optimum voltage LCcom, as shown in FIG. 10A. When the voltage LCcom is shifted to the higher level, the effective voltage by the negative polarity writing is raised, while the effective voltage by the positive polarity writing is lowered. Here, the final gray-scale level of a pixel is determined by an effective voltage value with two vertical scanning periods including the negative polarity writing and the positive polarity writing as a unit. Therefore, a small effective voltage value in the wiring polarity has a large effect. Thus, when the voltage LCcom shifts to a higher level, the difference between effective voltages in the positive polarity writing mainly appears as the difference between gray-scale levels.

As described above, the amount of pushdown generated in the data lines located at the boundaries between blocks is less than the amount of pushdown generated in the data lines in portions other than the boundaries between the blocks. Therefore, from the viewpoint of the effective voltage values, the pixels located at the boundaries between blocks have larger values than those in the portions other than the boundaries between blocks, and from the viewpoint of the gray-scale level, the pixels located at the boundaries between blocks appear to be darker than those in the portions other than the boundaries between blocks (normally white mode). Thus, in the display region 100*a*, longitudinal stripes having colors darker than gray are displayed on a gray background.

Next, in the second step, the control circuit 52 controls the regulator 3216 of the correction circuit 321 corresponding to the channel 1 to gradually increase the values of the adjustment data Px and Mx from zero at the same rate, and controls the regulator 3216 of the correction circuit 326 corresponding to the channel 6 to keep the values of the adjustment data Px and Mx zero.

In the adjustment mode, the adder 3226 (3236) adds the image data Vd1d (Vd6d) and the adjustment data Px (Mx). Therefore, when the values of the adjustment data Px and Mx increase, the result added by the adder 3226 (3236) also increases. Thus, the corrected image data Vd1f is changed so that the gray-scale level of a pixel may increase.

Figure 5B:
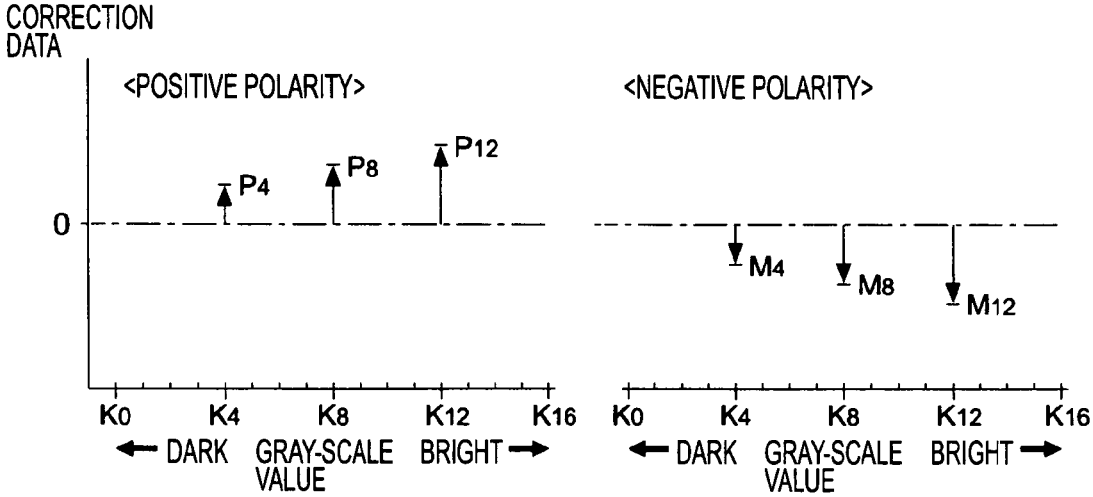

Therefore, since the pixel corresponding to the data line of the channel 1 among the longitudinal stripes is gradually darkened, the pixel has the same gray-scale level as those corresponding to the data lines of the channels 2 to 5, so that there are some times when some of the longitudinal stripes are removed. When it is determined that the gray-scale levels are equal to each other from the result of the imaging process on a display screen of the panel 100, the control circuit 52 controls the regulator 3216 of the correction circuit 321 corresponding to the channel 1 to stop increasing the values of the adjustment data Px and Mx, and stores or updates the adjustment data Px at that time as correction data $P_8$ corresponding to the gray-scale value $K_8$ of the positive polarity writing. In this way, the correction data $P_8$ corresponding to the gray-scale value $K_8$ of the positive polarity writing is obtained by the correction circuit 321 corresponding to the channel 1 (see FIG. 5B).

Similarly, the control circuit 52 controls the regulator 3216 of the correction circuit 326 corresponding to the channel 6 to gradually increase the values of the adjustment data Px and Mx from zero at the same rate. When it is determined that the gray-scale level of the pixel corresponding to the data line of the channel 6 is equal to those of the pixels corresponding to the data lines of the channels 1 to 5, from the result of the imaging process on the display screen of the panel 100, the control circuit 52 controls the regulator 3216 of the correction circuit 326 corresponding to the channel 6 to stop increasing the values of the adjustment data Px and Mx, and stores or updates the adjustment data Px at that time as correction data corresponding to the gray-scale value $K_8$ of the positive polarity writing. In this way, the correction data corresponding to the gray-scale value $K_8$ of the positive polarity writing is obtained by the correction circuit 326 corresponding to the channel 6.

Next, in the third step, the control circuit 52 controls the regulator 3216 of the correction circuit 321 (326) to set the values of the adjustment data Px and Mx to be zero.

Figure 10B:
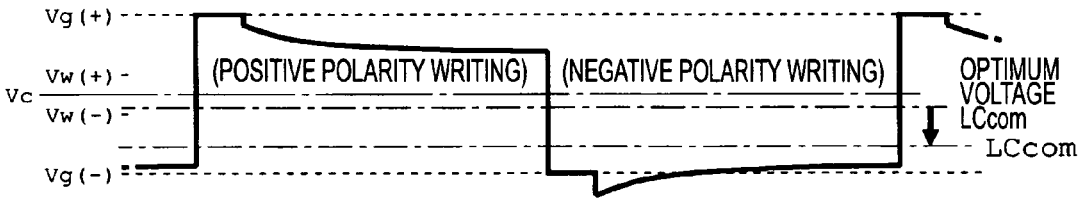

Further, in the third step, the control circuit 52 shifts the voltage LCcom to be applied to the common electrode 108 to a lower level than the optimum voltage LCcom, as shown in FIG. 10B. When the voltage LCcom shifts to the lower level, the effective voltage by the negative polarity writing is lowered, while the effective voltage by the positive polarity writing is raised. Therefore, the difference between effective voltages in the negative polarity writing mainly appears as the difference between gray-scale levels. Thus, in the display region 100*a*, longitudinal stripes having colors brighter than gray are displayed on a gray background.

Next, in the fourth step, the control circuit 52 controls the regulator 3216 of the correction circuit 321 corresponding to the channel 1 to gradually decrease the values of the adjustment data Px and Mx at the same rate, and controls the regulator 3216 of the correction circuit 326 corresponding to the channel 6 to keep the values of the adjustment data Px and Mx zero. Therefore, when the values of the adjustment data Px and Mx decrease, the result added by the adder 3226 (3236) is substantially a subtraction result. Thus, the corrected image data Vd1f is changed so that the gray-scale level of a pixel may be lowered.

Therefore, since the pixel corresponding to the data line of the channel 1 among the longitudinal stripes is gradually darkened, the pixel eventually has the same gray-scale level as those corresponding to the data lines of the channels 2 to 5, so that there are some times when some of the stripes are removed. When it is determined that the gray-scale levels are equal to each other from the result of the imaging process on the display screen of the panel 100, the control circuit 52 controls the regulator 3216 of the correction circuit 321 corresponding to the channel 1 to stop decreasing the values of the adjustment data Px and Mx, and stores or updates contents of the translation table 3232 so that the adjustment data Px at that time is correction data $M_8$ corresponding to the gray-scale value $K_8$ of the negative polarity writing. In this way, the correction data $M_8$ corresponding to the gray-scale value $K_8$ of the negative polarity writing is obtained by the correction circuit 321 corresponding to the channel 1.

Similarly, the control circuit 52 controls the regulator 3216 of the correction circuit 326 corresponding to the channel 6 to gradually decrease the values of the adjustment data Px and Mx at the same rate. When it is determined that the gray-scale level of the pixel corresponding to the data line of the channel 6 is equal to those of the pixels corresponding to the data lines of the channels 1 to 5, from the result of the imaging process on the display screen of the panel 100, the control circuit 52 controls the regulator 3216 of the correction circuit 326 corresponding to the channel 6 to stop decreasing the values of the adjustment data Px and Mx, and stores or updates contents of the translation table 3232 so that the adjustment data Px at that time is correction data corresponding to the gray-scale value $K_8$ of the negative polarity writing. In this way, the correction data corresponding to the gray-scale value $K_8$ of the negative polarity writing is obtained by the correction circuit 326 corresponding to the channel 6.

The first to fourth steps are repeated in a similar manner. That is, when the image data Vid designating the gray-scale value $K_4$ is supplied, the first to fourth steps are performed on the gray-scale value $K_4$. When the image data Vid designating the gray-scale value $K_8$ is supplied, the first to fourth steps are performed on the gray-scale value $K_8$.

In this way, positive correction data $P_4$ and $P_{12}$ and negative correction data $M_4$ and $M_{12}$ that correspond to the gray scale values $K_4$ and $K_{12}$ are obtained by the correction circuits 321 and 326 corresponding to the channels 1 and 6. Among them, the positive correction data $P_4$ and $P_{12}$ are stored in the translation table 3222, and the negative correction data $M_4$ and $M_{12}$ are stored in the translation table 3232 (see FIG. 5B).

Figure 5C:
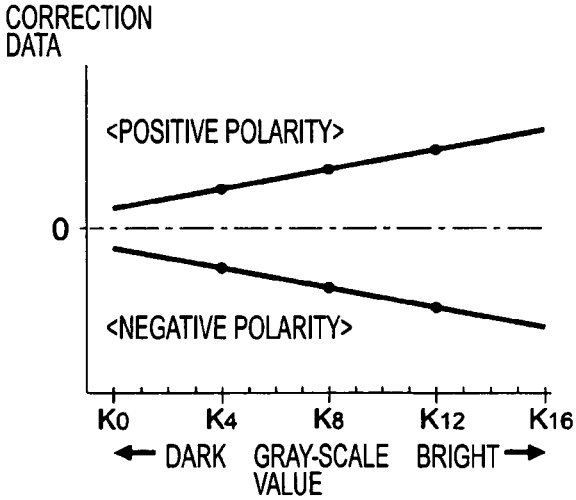

In this stage, only the positive correction data $P_4$, $P_8$, and $P_{12}$ and negative correction data $M_4$, $M_8$, and $M_{12}$ that correspond to the gray scale values $K_4$, $K_8$, and $K_{12}$ are obtained by the correction circuits 321 and 326 corresponding to the channels 1 and 6. Therefore, the control circuit 52 calculates correction data corresponding to other gray-scale values having positive polarities from the previously obtained correction data $P_4$, $P_8$, and $P_{12}$ by interpolation, and then stores the calculated data in the translation table 3222. In addition, similarly, the control circuit 52 calculates correction data corresponding to other gray-scale values having negative polarities from the previously obtained correction data $M_4$, $M_8$, and $M_{12}$ by interpolation, and then stores the calculated data in the translation table 3232. In this way, for example, according to characteristics shown in FIG. 5C, positive correction data $P_4$ to $P_{16}$ respectively corresponding to gray-scale values $K_0$ to $K_{16}$ are stored in the translation table 3222, and negative correction data $M_0$ to $M_{16}$ respectively corresponding to the gray-scale values $K_0$ to $K_{16}$ are stored in the translation table 3232. It goes without saying that the interpolation is performed on two channels 1 and 6.

Further, in the present embodiment, the gray-scale values $K_4$, $K_8$, and $K_{12}$ are selected as representative values. However, the gray-scale values may be in the range of gray approximate to intermediate values therebetween. This is because the voltage-transmittance (reflectance) characteristic of liquid crystal steepest changes in gray, so that the difference between effective voltages easily appears as-a difference in display. That is, the gray-scale range approximate to the lowest gray-scale value $K_0$ and the gray-scale range approximate to the highest gray-scale value $K_{16}$, have a large difference between effective voltages, but hardly appear as a difference in display. Therefore, it is difficult to use these gray-scale ranges as gray-scale values, which are reference values of interpolation.

Next, the operation of the correction circuit 321 (326) in the display mode will be described. In the display mode, a normal display operation is considered, and thus the CCD camera used in the adjustment mode is not needed.

First, when the positive polarity writing is designated by the signal PL, the selector 3212 selects the output terminal A, and the selector 3214 selects the input terminal A. Therefore, the image data Vd1d (Vd6d) passes through the translation table 3222 and the adders 3224 and 3226 to be corrected.

In this path, the positive correction data corresponding to the gray-scale level designated by the image data Vd1d (Vd6d) is read out from the translation table 3222, and the adder 3224 adds the correction data and the image data Vd1d (Vd6d). Since the adjustment data Px is zero in the display mode, the corrected image data Vd1f (Vd6f) is obtained by adding the image data Vd1d (Vd6d) and the positive correction data.

On the other side, when the negative polarity writing is designated by the signal PL, the selector 3212 selects the output terminal B, and the selector 3214 selects the input terminal B. Therefore, the image data Vd1d (Vd6d) passes through the translation table 3232 and the adders 3234 and 3236 to be corrected.

In this path, the negative correction data corresponding to the gray-scale level designated by the image data Vd1d (Vd6d) is read out from the translation table 3232, and the adder 3224 adds the correction data and the image data Vd1d (Vd6d). Since the adjustment data Mx is zero in the display mode, the corrected image data Vd1f (Vd6f) is obtained by adding the image data Vd1d and the negative correction data.

In the present embodiment, as described above, both the positive correction data and the negative correction data are used to correct the image data Vd1d (Vd6d) such that the voltage finally held in the data line corresponding to the channel 1 (6) is equal to the voltage finally held in the data lines corresponding to the channels 2 to 5. Therefore, when display is performed in a wide area of the display region 100*a* at the same gray-scale level, the voltages finally written on the respective pixels are equal to each other, which results in preventing the generation of longitudinal stripe-shaped color unevenness in the display region 100*a*.

Furthermore, in the above-mentioned embodiment, in the adjustment mode, after the correction data corresponding to the representative gray-scale values is obtained, correction data corresponding to the other gray-scale values is calculated by interpolation, and then correction data corresponding to each gray-scale value is stored in the translation table 3222 (3232). In the display mode, the correction data corresponding to the gray-scale value designated by the image data is read out from the translation table 3222 (3232). However, the following structure may be used.

That is, in the adjustment mode, first, correction data corresponding to representative gray-scale values may be calculated, and then only the correction data may be stored in the translation table 3222 (3232). In the display mode, when the gray-scale value designated by the image data is stored in the translation table 3222 (3232), the gray-scale value may be read out therefrom. However, when it is not stored in the translation table 3222 (3232), the gray-scale value may be calculated from the correction data of the stored gray-scale values by interpolation.

In other words, the interpolation may be performed in the adjustment mode as described in the present embodiment, or may be performed in the display mode.

As described in the present embodiment, in the structure in which interpolation is performed in the adjustment mode, the delay of calculation caused by the interpolation in the display mode may not be considered, but storage capacity required for the translation table 3222 (3232) increases. On the other side, in the structure in which interpolation is performed in the display mode, storage capacity required for the translation table 3222 (3232) decreases, but it is necessary to consider the delay of calculation caused by the interpolation in the display mode.

Further, in the present embodiment, in general, parasitic capacitance exists in the respective data lines 114. Therefore, when data signals are sampled in the horizontal effective display period, the voltages of the data signals remain therein until the next sampling operation. Thus, in the horizontal retrace period, the respective data lines 114 may be pre-charged with a predetermined voltage to remove the remaining voltage components, and in the horizontal effective display period, data signals may be sampled to the data lines 114.

Figure 11:
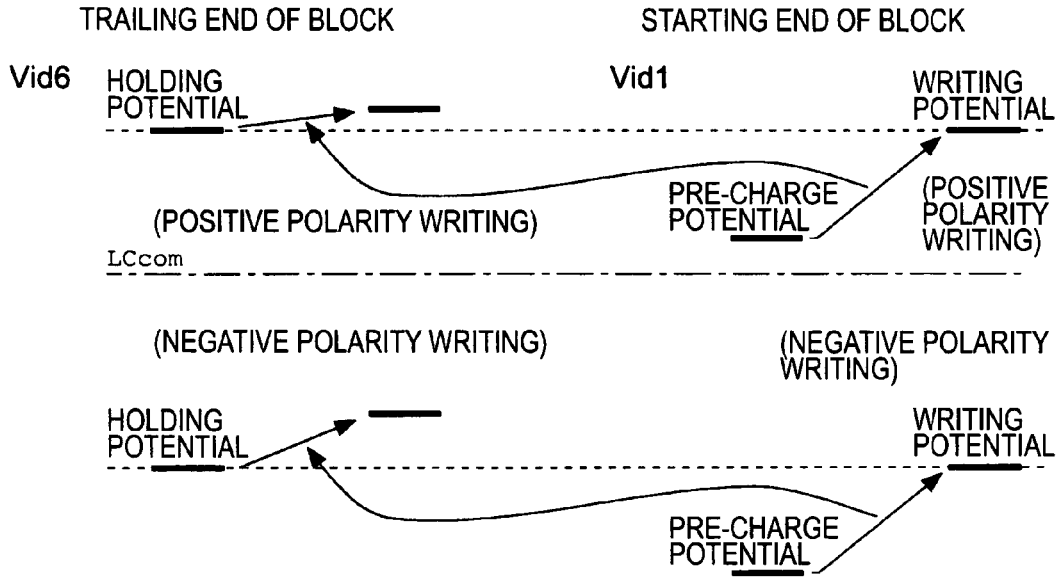
FIG. 11 is a view illustrating the influence of a potential change from a pre-charge potential to a writing potential.

FIG. 11 shows an example in which, before the positive polarity writing, the data lines are pre-charged with a voltage approximate to the voltage LCcom, and in which, before the negative polarity writing, the data lines are pre-charged with a voltage approximate to zero.

As shown in FIG. 11, in a case in which such pre-charging is performed, when a certain block is selected, the potential of a data line in the selected block corresponding to the channel 1 is changed from a pre-charge potential to a writing potential.

Here, since the voltage of a data line located at the right side of the data line is simultaneously changed with the voltage of the data line, the data line at the right side is little affected by the voltage variation of the data line. However, since a data signal has already been sampled to a data line located at the left side of the data line corresponding to the channel 1, the data line located at the left side is affected by the voltage variation of the data line corresponding to the channel 1.

Therefore, when horizontal scanning is performed in the right direction, the voltage of a data line located at the left side of the data line corresponding to the channel 1 in a certain block (more specifically, a data line corresponding to the channel 6 in a block that has been selected one stage ahead of the block in a position) varies by the voltage variation of the data line corresponding to the channel 1.

Accordingly, the voltage of the data line corresponding to the channel 6 varies by the pre-charge voltage as well as the pushdown amount.

Meanwhile, in the present embodiment, in the first step of the adjustment mode, the voltage LCcom of the common electrode 108 shifts to a higher level, and in the third step, the voltage LCcom shifts to a lower level. Here, the voltage LCcom shifts to a higher level in the first step in order that the difference between effective voltages in the positive polarity appears as a difference in display, and the voltage LCcom shifts to a lower level in the third step in order that the difference between effective voltages in the negative polarity appears as a difference in display.

Figure 12A:
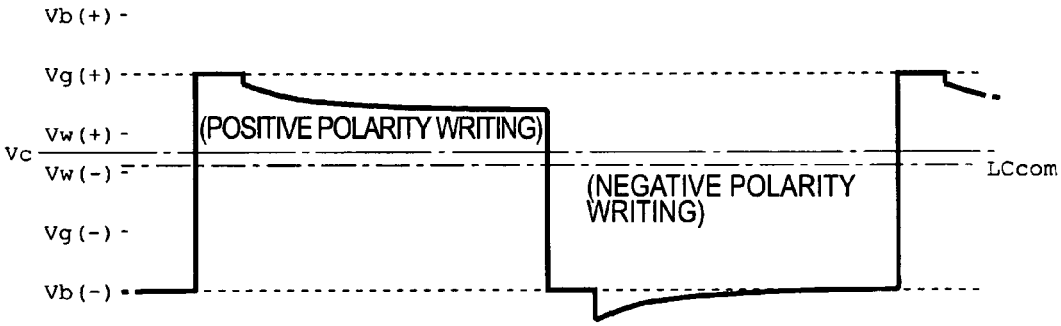
FIGS. 12A and 12B are views illustrating the same effect as the shift of the voltage LCcom has.
Figure 12B:
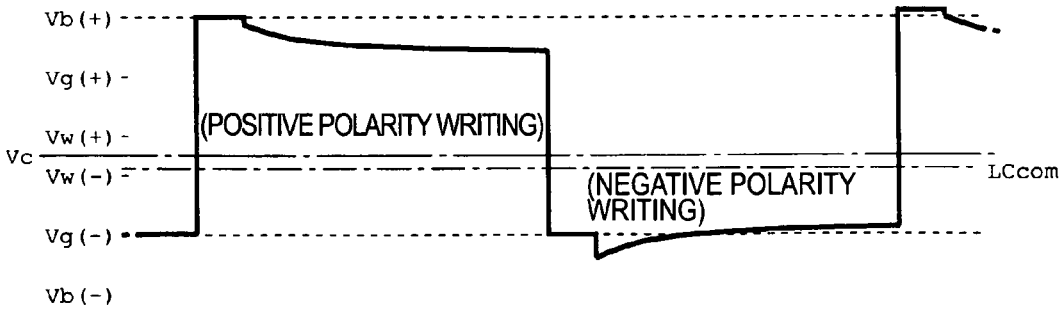

In order that the difference between effective voltages in the positive or negative polarity appears as a difference in display, the following method can be used in addition to the structure in which the voltage LCcom shifts to the higher or lower level. That is, in the first step of the adjustment mode, the image data Vid is replaced with data designating the lowest gray-scale level (a gray-scale level where the highest effective voltage is obtained) at the time of the negative polarity writing. When such replacement is performed, a voltage waveform applied to the pixel electrode 118 is the same as that obtained by shifting the voltage LCcom to a higher level, as shown in FIG. 12A. Therefore, the difference between effective voltages in the positive polarity appears as a difference in display. Similarly, in the third step of the adjustment mode, the image data Vid is replaced with data designating the lowest gray-scale level at the time of the positive polarity writing. When such replacement is performed, a voltage waveform applied to the pixel electrode 118 is the same as that obtained by shifting the voltage LCcom to a lower level, as shown in FIG. 12B. Therefore, the difference between effective voltages in the negative polarity appears as a difference in display.

When such replacement is performed, the gray-scale level is not limited to the lowest gray-scale level, but a gray-scale level approximate thereto may be used if the same effect can be obtained. More specifically, when the brightness of the lowest gray-scale level is 0%, the gray-scale range corresponding to 10% of brightness or less may be set.

In the present embodiment, in the first and second steps, the positive correction data is calculated, and then the negative correction data is calculated in the third and fourth steps. However, in the first and second steps, the negative correction data may be calculated, and then the positive correction data may be calculated in the third and fourth steps.

Further, in the present embodiment, vertical scanning is performed in the downward direction from G1 to Gm, and horizontal scanning is performed in the right direction from S1 to Sn. However, in case of a projector or rotary display device, which will be described later, it is necessary to invert the scanning direction.

Furthermore, when a method of supplying the image data Vid is changed, the scanning lines are not necessarily selected in the order of the first, second, and third rows. For example, the scanning lines may be selected in the order of 1, 3, 5, . . . , (m−1), 2, 4, 6, . . . , m. That is, after a certain scanning line is selected, another scanning line may be selected, and then in a unit period (vertical scanning period), all scanning lines may be finally selected.

Further, in the present embodiment, the positive polarity writing is performed in one vertical scanning period, and the negative polarity writing is performed in the next one vertical scanning period. Therefore, two vertical scanning periods are required for alternating current driving. In addition, it goes without saying that the alternating current driving may be performed in a period longer than the two vertical scanning periods.

In the above-mentioned embodiment, each block is composed of six data lines, and a phase expansion method is adopted in which the image data Vd1d to Vd6d are converted into six channels. However, the number of channels and the number of data lines (that is, the number of data lines belonging to one block) to which signals are simultaneously applied are not limited to the number '6'. In addition, when correction circuits are respectively provided at the data lines, the present embodiment can be applied to a dot-sequential method, in addition to the phase expansion method.

Meanwhile, in the above-mentioned embodiment, the data signal supply circuit 300 processes the digital image data Vid, but may process analog image signals. In addition, in the above-mentioned embodiment, when the effective voltage value between the common electrode 108 and the pixel electrode 118 is small, the normally white mode for white display is performed. However, in this case, a normally black mode for black display may be performed.

Further, in the above-mentioned embodiment, the TN liquid crystal is used. Instead, the liquid crystal may be of a bi-stable twisted nematic (BTN) type, a writable bi-stable type, such as a ferrodielectric type, a polymer dispersion type, a guest-host (GH) type which a dye (guest) having anisotropic visible light absorbency in the long axis and the short axis of molecules is dissolved in liquid crystal (host) having a predetermined molecular arrangement so that the dye molecules and the liquid crystal molecules are arranged parallel to each other.

Moreover, a vertical (homeotropic) alignment structure may be used in which the liquid crystal molecules are arranged perpendicular to two substrates when no voltage is applied and in which the liquid crystal molecules are arranged parallel to the two substrates when a voltage is applied. In addition, a parallel (homogeneous) alignment structure may be used in which the liquid crystal molecules are arranged parallel to the two substrates when no voltage is applied and in which the liquid crystal molecules are arranged perpendicular to the two substrates when a voltage is applied. Accordingly, the invention can be applied to various types of liquid crystal and alignment structures.

Figure 13:
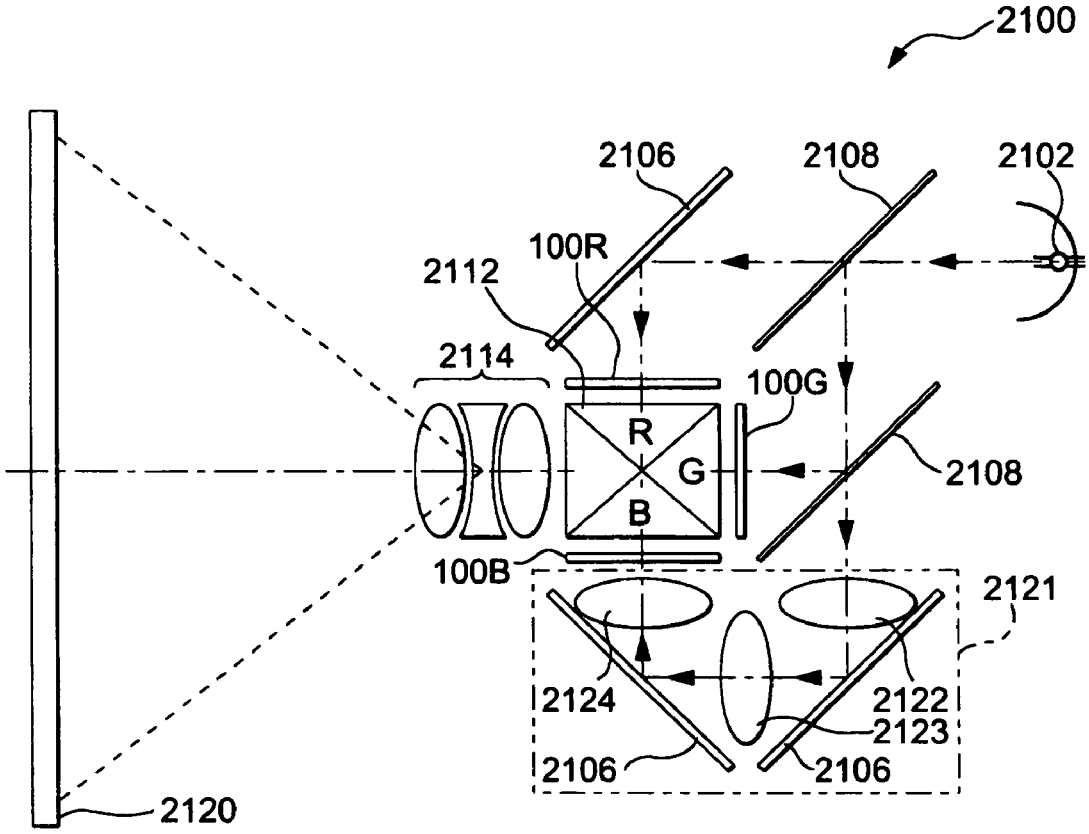
FIG. 13 is a view illustrating the structure of a projector, which is an example of an electronic apparatus to which the electro-optical device is applied.

Next, a projector using the electro-optical device 100 as a light valve is described as an example of an electronic apparatus using the electro-optical device according to the above-mentioned embodiment. FIG. 13 is a plan view illustrating the structure of this projector. As shown in this drawing, a projector 2100 is provided with a lamp unit 2102 composed of a white light source, such as a halogen lamp. Projection light emitted from the lamp unit 2102 is divided into three primary color beams R (red), G (green), and B (blue) by three mirrors 2106 and two dichroic mirrors 2108 that are provided therein, and the three primary color beams are introduced to light valves 100R, 100G, and 100B corresponding to the respective color beams. Since the B light beam has an optical path longer than those of the R light beam and the G light beam, the B light beam is introduced via a relay lens system 2121 including an incident lens 2122, a relay lens 2123, and an emission lens 2124 in order to prevent optical loss.

Herein, the structure of the light valves 100R, 100G, and 100B is the same as that of the panel 100 according to the above-mentioned embodiment, and the light valves 100R, 100G, and 100B are respectively driven by image signals corresponding to the colors R, G, and B supplied from a processing circuit (not shown in FIG. 13). That is, in the projector 2100, three electro-optical devices each including the panel 100 are provided to correspond to the colors R, G, and B, and color unevenness on the panels corresponding to the respective colors is corrected so as not to be perceived by the human eye.

Light beams respectively modulated by the light valves 100R, 100G, and 100B are incident on a dichroic prism 2112 in the three directions. In the dichroic prism 2112, the R light beam and the B light beam are reflected at an angel of 90°0, while the G light beam travels straight. After a color image is synthesized from these color light beams, the color image is projected onto a screen 2120 through a projection lens 2114.

Since the R, G, and B light beams are incident on the light valves 100R, 100G, and 100B through the dichroic mirrors 2108, respectively, it is not necessary to provide color filters as described above. The images passing through the light valves 100R and 100B are reflected by the dichroic mirror 2112 and are projected, while the image passing through the light valve 100G is directly projected. Thus, the horizontal scanning directions by the light valves 100R and 100B are opposite to the horizontal scanning direction by the light valve 100G, thereby displaying a mirror-reversed image.

Examples of electronic apparatuses other than the electronic apparatus described with reference to FIG. 13 include television sets, view-finder-type and monitor-direct-view-type videotape recorders, car navigation systems, pagers, electronic notebooks, electronic organizers, electronic calculators, word processors, workstations, TV telephones, POS terminals, digital still cameras, cellular phones, and apparatuses provided with touch panels. Of course, the display panel in accordance with the invention can be applied to these various electronic apparatuses.

What is claimed is:

1. An electro-optical device comprising:

a plurality of scanning lines that extend in a row direction;

a plurality of data lines that extend in a column direction, tile data lines being grouped into data line blocks each composed of a separate plurality of data lines;

a plurality of pixels which correspond to intersections of the scanning lines and the data lines and whose gray-scale levels are designated by data signals supplied through the data lines;

a common electrode that is provided opposite to the pixel electrodes;

a shift register that outputs sampling signals;

a sampling circuit including sampling switch blocks that correspond to the data line blocks and that receive the sampling signals one sampling switch block at a time in a sequential manner, each sampling switch block having plural sampling switches that simultaneously sample data signals to the data lines of the corresponding data line block based on a received sampling signal;

a data signal supply circuit that switches a potential of the data signal between a higher level and a lower level than a predetermined potential in every predetermined period and then alternately outputs the potentials accordingly; and a correction circuit that superimposes correction signals on the data signals, the correction signals corresponding to the potentials of the data lines and correcting errors in the potentials of the data lines based on a difference between a pushdown amount of tile potential of a data line of a first data line block that is adjacent to a data line of an adjacent data line block and a pushdown amount of the potential of a data line of the first data line block located at a position other than adjacent to a data line of an adjacent data line block.

2. The electro-optical device according to claim 1, wherein the correction circuit separately sets a correction amount of the data signal by the correction signal when the data signal has the higher potential and when the data signal has the lower potential.

3. The electro-optical device according to claim 1, wherein the correction circuit includes:

a first translation table that stores correction data indicating a correction amount that is set corresponding to a gray-scale level designated by the data signal having the higher potential; and a second translation table that stores correction data indicating a correction amount that is set corresponding to a gray-scale level designated by the data signal having the lower potential.

4. The electro-optical device according to claim 3, wherein, when the correction data corresponding to the gray-scale level designated by the data signal is stored in the first or second translation table, the correction circuit reads out the stored correction data, and when the correction data corresponding to the gray-scale level designated by the data signal is not stored in the first or second translation table, the correction circuit calculates, from the stored correction data, the correction data corresponding to the gray-scale level designated by the data signal using interpolation.

5. The electro-optical device according to claim 1, wherein the correction circuit corrects the data signals supplied to the data lines located at boundaries between the blocks.

6. An electronic apparatus comprising the electro-optical device according to claim 1.

* * * * *